United States Patent [19]

Williams et al.

[11] Patent Number: 4,848,930

[45] Date of Patent: Jul. 18, 1989

[54] FREE-STANDING PLASTIC BAG

[75] Inventors: David R. Williams, Piscataway, N.J.; Mary M. Watson, Bronxville, N.Y.

[73] Assignee: Trinity Paper & Plastics Corporation, New York, N.Y.

[21] Appl. No.: 81,863

[22] Filed: Aug. 5, 1987

[51] Int. Cl.[4] ..... F16C 32/06

[52] U.S. Cl. ..... 383/104; 383/10; 383/120; 383/119

[58] Field of Search ..... 383/104, 120, 121, 7, 383/9, 10, 14, 119

[56] References Cited

U.S. PATENT DOCUMENTS

| | | | |
|---|---|---|---|
| 1,355,353 | 10/1920 | Pease | 383/10 |
| 1,410,404 | 3/1922 | Haines | 383/10 |
| 2,036,687 | 4/1936 | Fisher | 383/10 |
| 2,543,299 | 2/1951 | Pritchard | 383/7 |
| 3,618,478 | 11/1971 | Piazze | 383/120 |
| 3,682,372 | 8/1972 | Rodley | 383/104 |
| 4,059,222 | 11/1977 | Gamble | 383/10 |
| 4,691,368 | 9/1987 | Roessiger | 383/10 |

*Primary Examiner*—Willis Little

*Attorney, Agent, or Firm*—Darby & Darby

[57] ABSTRACT

A plastic bag is disclosed of the type which is constructed from a front and rear wall which are folded upwardly at the bottom to form a gusset. The front and rear walls are sealed together along their entire lateral margins, except that the upper portion of each wall is provided with an unsealed flap or cuff portion. Diagonal welds are formed in the lower corner of each wall, so as to seal the wall to the underlying gusset wall, but the gusset walls are not sealed to each other. To complete the bag, each cuff portion is folded downwardly over the corresponding wall. The cuff portions are provided with cut-out openings. Afer the bag is filled, the cuff portions may be unfolded and used as carrying handles, with the cut-out openings serving as hand holes.

4 Claims, 1 Drawing Sheet

FIG. 1
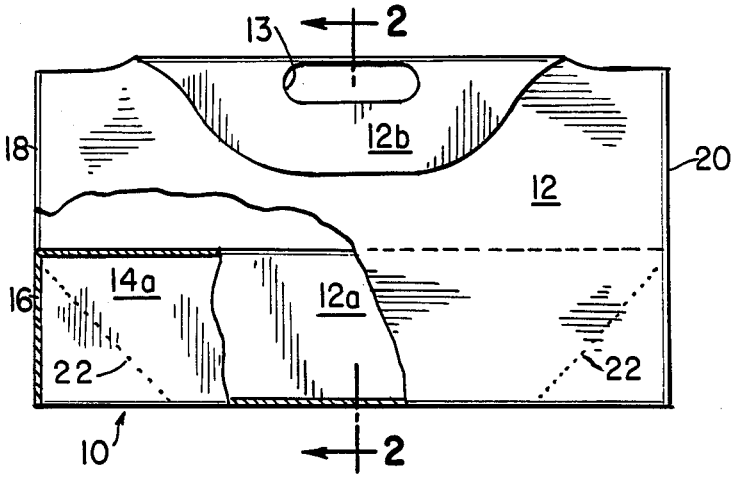
FIG. 2
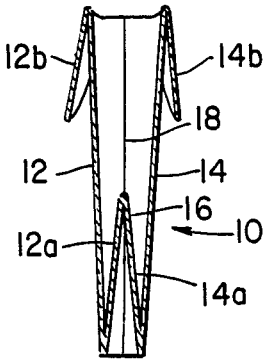
FIG. 3 C13
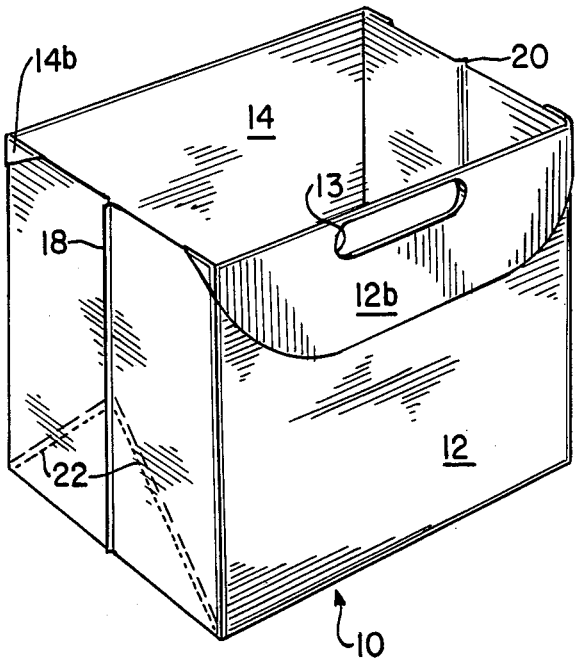
FIG. 4
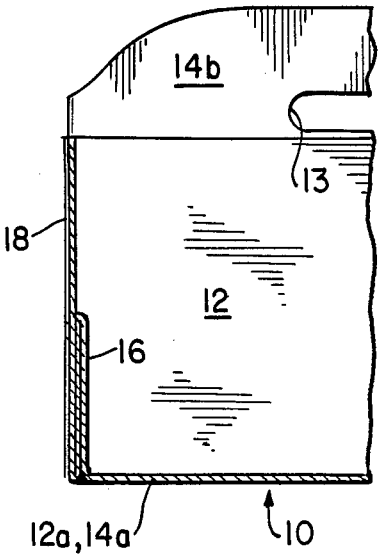

FREE-STANDING PLASTIC BAG

FIELD OF THE INVENTION

The present invention relates generally to plastic bags and, more particularly, concerns an improved plastic bag which is capable of standing freely, in a self-supported position, when fully opened.

BACKGROUND OF THE INVENTION

Plastic film has long been a popular material for packaging applications. Plastic bags, in particular, have found broad application. Moreover, they have remained an economical type of packaging, because of the relatively low cost of the basic plastic materials and the low cost of manufacturing the plastic bags therefrom, owing to the efficient application of mass production techniques. However, the use of plastic bags has been limited, to some extent, by the fact that the thin plastic films utilized for such bags lack sufficient rigidity to permit the bag to stand upright, in an opened position, when empty.

In certain applications, for example, supermarket shopping bags and bags utilized in fast food restaurants, it is essential that bags used for merchandise be capable of standing upright and be self-supporting while empty. Individuals selling merchandise can then concentrate on handling the merchandise with both hands, instead of having to fumble wth the bag in an effort to support it while trying to fill it. For this reason, supermarkets, for example, have either tended to continue utilizing more rigid paper bags, or they have adopted plastic bags, but utilize a special supporting stand for the bags while they are being filled.

In U.S. Pat. No. 3,437,258, there is disclosed a self-supporting liquid-filled bag. The bag includes front and rear walls which are folded to form a bottom gusset. The lateral edges of the front and rear walls are sealed together, and a diagonal weld is formed in the lower corner of each wall so as to seal the wall to the gusset along each weld. As the bag is filled with liquid, the diagonal welds at the corners of the gusset cause the bottom of the bag to spread outwardly, forming a stable base for the liquid-filled bag.

Although the bag construction of U.S. Pat. No. 3,437,258 permits a liquid-filled bag to stand upright, it does not provide a satisfactory construction for supporting an empty bag in an upright position while it is being filled with solid materials. Even if the bottom of the bag is spread open so as to form a stable base, the front and rear walls do not have adequate support, and a person filling such a bag with solid items must constantly keep opening it.

Broadly, it is an object of the present invention to overcome the disadvantages of prior art plastic bags of the type described. It is specifically contemplated that the present invention provide a free-standing bag which will remain open when empty, so that it may be filled with solid materials, without the need to support the bag in any way.

It is another object of the present invention to provide such a plastic bag which is convenient and reliable in use, yet inexpensive in construction.

In accordance with the present invention, a plastic bag is constructed from a front and rear wall which are folded upwardly at the bottom to form a gusset. The front and rear walls are sealed together along their entire lateral margins, except that the upper portion of each wall is provided with an unsealed flap or cuff portion. Diagonal welds are then formed in the lower corner of each wall, so as to seal the wall to the underlying gusset wall. To complete the bag, each cuff portion is folded donwardly over the corresponding wall. Conveniently, the cuff portions are provided with cutout openings. After the bag is filled, the cuff portions may then be unfolded and used as carrying handles, with the cut-out openings serving as hand holes.

It is a feature of the present invention that the downwardly folded cuff portions lend themselves to the front and rear walls, whereby when an empty bag is opened, it stands freely in an open, self-supporting position.

BRIEF DESCRIPTION OF THE DRAWING

The foregoing brief description, and further objects features and advantages of the present invention will be understood more completely from the following detailed description of a presently preferred, illustrative embodiment, with the reference being had to the accompanying drawing, wherein:

FIG. 1 is a front elevational view of a plastic bag incorporating objects and features of the present invention with parts cut away to show details of construction;

FIG. 2 is a sectional view of the plastic bag of FIG. 1 taken along line 2—2 in FIG. 1 and looking in the direction of the arrows;

FIG. 3 is a perspective view illustrating the bag of FIG. 1 in its fully opened, self-supporting position; and FIG. 4 is a fragmentary sectional view of the bag shown in FIG. 3, taken along the side seals of the bag and looking toward the rear thereof, the cuff portion of the rear wall being shown in an upright, unfolded position to illustrate how it may be used as a carrying handle after the bag is filled.

DETAILED DESCRIPTION

Turning now to the details of the drawing, a plastic bag 10 is illustrated which embodies objects and features of the present invention. The particular bag illustrated is useful for fast food restaurant applications. The bag includes front and rear walls 12 and 14, which include a bottom wall portion (**12*a* and 14*a* respectively), which is folded upwardly to form a bottom gusset 16. Walls 12 and 14** and the bottom walls are preferably formed from a continuous sheet of plastic material.

In addition, the walls 12 and 14 include upper flap or cuff portions, **12*b* and 14*b* respectively, each of which is folded downwardly over the corresponding wall by forming a crease line at the top of the bag front and rear walls. The cuff portions preferbly taper upwardly, but this is not an essential feature. They are also preferably provided with cut out holes 13. Except for the cuff portions 12*b* and 14*b*, all portions of walls 12 and 14 are sealed together by means of lateral heat seals or welds 18 and 20**.

In the lower corners of each of walls 12 and 14, there are formed diagonal welds 22, each of which extends between a bottom edge and side edge (welds 18 and 20) of the respective wall, and each of which joins the corresponding wall 12 or 14 to the underlying gusset wall. The welds 22 do not join the two gusset walls together.

In use, the bag of the present invention is conveniently opened by placing one's thumbs inside the bag and grabbing front wall 12 with one hand and rear wall 14 with the other. If the bag is then quickly snapped through the air, in-rushing air causes the bag to open and also causes the top edge 16*a* of gusset 16 to move toward the bottom edges of walls 12 and 14. Owing to the presence of the welds 22, the walls 12 and 14 are spread apart and the lower triangular sections defined by the welds 22 become part of a side wall for the bag. Gusset 16 may then be flattened out by hand to form a bottom wall for the bag, or this happens automatically when merchandise is dropped into the bag.

In FIGS. 3 and 4, the appearance of the bag is shown somewhat exaggerated for convenience of illustration. The actual bag will not have sharp corner edges or flat side walls as shown in FIG. 3, but would be somewhat oblong. The folded down cuff portions 12*b* and 14*b* do, however, serve to hold the bag open and to support the front and rear walls thereof. The bag is then conveniently filled, without having to be held or supported in an opened position. After the bag is completely filled, the cuff portions 12*b* and 14*b* are conveniently unfolded and used as carrying handles, with the holes 13, 13 serving as hand holes.

Although a preferred embodiment of the invention has been disclosed for illustrative purposes, those skilled in the art would appreciate that many additions, modification and substitutions are possible, without departing from the scope and the spirit of the invention as defined by the accompanying claims.

What is claimed is:

1. A plastic bag which is capable of maintaining a self-supporting, open position when empty, said bag comprising:

front and rear walls formed form a continuous sheet of heat sealable, flexible material, said front and rear walls each having a bottom wall portion, the bottom wall portions being folded upwardly between said front and rear walls so as to form a gusset;

side welds formed at either lateral edge of said front and rear walls so as to secure said front and rear walls and said bottom wall portions together;

a diagonal weld formed at each bottom corner of each of said front and rear walls so as to extend between a side weld and the bottom of said wall, said diagonal welds being effective to secure the respective one of said front and rear walls to the immediately underlying bottom wall portion forming a gusset thereunder, said bottom wall portions not being secured together by said diagonal welds; and a cuff portion formed at the top of each of said front and rear walls so as to extend thereabove, said cuff portion being free of said lateral welds so as to form separate front and rear cuff elements, and means for retaining each of said cuffs in a freely downwardly folded position over the corresponding one of said front and rear walls, at least during filling of the bag.

2. A bag in accordance with claim 1, wherein each of said cuff portions is shaped so as to taper in an upward direction.

3. A bag in accordance with claim 2, wherein each of said cuff portions is cut out so as to have a hole in its surface, said cuff elements being unfolded and used as carrying handles when the bag is filled, the holes in each of said cuff elements serving as hand holes.

4. A bag in accordance with claim 1, wherein each of said cuff elements is cut out so as to have a hole in its surface, said cuff portions being unfolded and used as carrying handles when the bag is filled, the holes in each of said cuff elements serving as hand holes.

* * * * *